US006151733A

United States Patent [19]

Takashima

[11] Patent Number: 6,151,733

[45] Date of Patent: Nov. 28, 2000

[54] PILLOW FOR AN INDIVIDUAL AND THE METHOD FOR PRODUCING A PILLOW FOR AN INDIVIDUAL

[76] Inventor: Hisato Takashima, 5-18, Kasuga-cho, Takatsuki-shi, Osaka-fu, 569-0053, Japan

[21] Appl. No.: 09/236,701

[22] Filed: Jan. 25, 1999

[30] Foreign Application Priority Data

Jan. 26, 1998 [JP] Japan ..... 10-029247

[51] Int. Cl.[7] ..... A47G 9/00

[52] U.S. Cl. ..... 5/636; 5/640; 5/641; 5/643; 5/645

[58] Field of Search ..... 5/636, 639, 640, 5/641, 643, 645, 490, 951

[56] References Cited

U.S. PATENT DOCUMENTS

| | | | |
|---|---|---|---|
| 1,020,444 | 3/1912 | Platt | 5/645 |
| 1,206,775 | 11/1916 | Everts | 5/645 |
| 3,148,389 | 9/1964 | Lustig | 5/643 X |
| 3,243,828 | 4/1966 | McCarty | 5/636 |
| 3,411,164 | 11/1968 | Sumergrade | 5/645 X |
| 3,638,255 | 2/1972 | Sterrett | 5/641 |
| 4,756,035 | 7/1988 | Beier | 5/640 |
| 5,016,303 | 5/1991 | Tanaka et al. | 5/636 |
| 5,038,432 | 8/1991 | Robillard et al. | 5/645 |
| 5,168,590 | 12/1992 | O'Sullivan | 5/636 X |
| 5,367,731 | 11/1994 | O'Sullivan | 5/645 |
| 5,471,691 | 12/1995 | Ryndak | 5/645 |
| 5,644,810 | 7/1997 | Kato | 5/490 X |
| 5,809,594 | 9/1998 | Isogai | 5/645 |
| 5,918,333 | 7/1999 | Takashima | 5/636 X |
| 5,937,460 | 8/1999 | Humphries | 5/636 X |
| 5,953,777 | 9/1999 | Buck | 5/636 |
| 5,987,676 | 11/1999 | Littleford et al. | 5/636 |
| 6,006,380 | 12/1999 | Sramek | 5/636 |

*Primary Examiner*—B. Dayoan
*Assistant Examiner*—Robert G. Santos
*Attorney, Agent, or Firm*—Curtis L. Harrington

[57] ABSTRACT

The object of the present invention is to provide a pillow which has the pillow user's most comfortable height and shape and which he can have a comfortable sleep with a relaxed posture and in which he is not prevented from turning in bed and in which is free from headache or nausea from receiving pressure on his neck. The method for producing a pillow which can have the most comfortable height and shape which differs in accord with body shape and sleeping posture is shown and described. Furthermore, a pillow is disclosed for an individual having a flat pad and a cushion having a convex portion as its basic components, and in which necessary numbers of pads used for adjusting height as well as pads for adjusting pressure on cervical vertebra can be added into a flat pad and said cushion having a convex portion and insertable into a cover. The flat pad, the cushion having a convex portion, the pad for adjusting a height and the pad for adjusting pressure on cervical vertebra are then prepared and a bottom of the cushion having a convex portion is flat and the upper surface of it is curved for fitting a shape of a portion along from a pillow user's head to neck.

3 Claims, 8 Drawing Sheets

PILLOW FOR AN INDIVIDUAL AND THE METHOD FOR PRODUCING A PILLOW FOR AN INDIVIDUAL

FIELD OF THE INVENTION

This invention relates to a pillow for an individuals use and the method for producing a pillow for an individual and has as one of its objectives to provide a pillow which is adjustable to the pillow user's most favorite height and shape and by which a pillow user can have a comfortable sleep without preventing him from turning in bed, and without having an headache and feeling nausea due to receiving a pressure on his neck. Another object is for a method for producing a pillow for an individual wherein the most comfortable height and shape can be adjustable in accordance with differences of a persons body figure and a sleeping posture.

PRIOR ART

A pillow has a great influence in a comfortable sleep and is believed to determine whether people can sleep comfortably. The most important factor is the use of the most comfortable pillow for each person for a comfortable sleep. Although at first thought, the factors as a condition of comfortable sleep might seem to be pillow height, hardness, material, size, fragrance, color and sound fitting the individual taste of a pillow user, other conditions include, non-stuffiness conditions relating to the head's ventilation, absorption of humidity and moisture vaporization, especially since it is advantageous to superior to naturally absorb and release sweat during sleep. Further, heat insulation and the ability to naturally turn in bed are also considered as elements of the most comfortable pillow.

Recently, it has been found that having a structure to support the cervical vertebra properly in order to avoid prevention of blood running to the nervous system and tissue near the a cervical vertebra, and thus this is also considered as one of elements of a most comfortable pillow. Currently there are many kinds of pillow shapes produced for supporting cervical vertebra. For example, there are a pillows having a concave portion for supporting the head between two apex shapes which act as a support for a portion of the cervical vertebra, and is referred to as a concave shaped pillow or a doughnut-shaped pillow. This pillow has a portion touching the neck which is high, and a portion touching the head is low. A center portion has a hollow shape.

Problems to be Solved

However, presently available pillows which have a shape for supporting cervical vertebra such as the concave shaped pillow and doughnut-shaped pillow have several problems. Generally there are two common sorts of a sleeping posture including sleeping on one's back facing upward and sleeping while lying on one's side. It is difficult for a pillow user who lies on his side to use the concave shaped pillow and the doughnut-shaped pillow, because the pillow user can not turn to shift positions in bed because his head is held fixed within the pillow. Due to this factor, a problem such as an interruption in blood circulation which causes bedsores arises. The most comfortable height and shape of a pillow greatly differs in accord with the needs of each pillow user and also differs by not only personal body figure but also a preference for particular sleeping postures. Since the concave shaped pillow and the doughnut-shaped pillow are prepared based on the common height and shape of larger numbers of people, they can not be adjusted for fitting the taste of each person. As a result, a height and a shape of a portion of the pillow supporting a cervical vertebra of the pillow do not fit each pillow user's body figure and this causes a pillow user to get a headache and feelings of nausea from receiving pressure from the pillow.

Therefore, a pillow for an individual which is configured for the pillow user's most favorite height and shape, by which the pillow user can easily turn to change position in bed and by which the pillow user will not have a headache and feel nauseous from receiving pressure on his neck is most desirable. A pillow configured so that the pillow user can sleep with a relaxed posture, and a method for producing a pillow for an individual which can be adjusted to a pillow user's most comfortable height and shape in accordance with differences of personal body figure and sleeping posture of each pillow user is highly desirable.

SUMMARY OF THE INVENTION

The present invention was produced to solve the aforementioned problems. The present in invention relating to the claims is a pillow, for an individual, having a flat pad and a cushion having a convex portion as a basic component, and wherein necessary numbers of pads for adjusting height and pads for adjusting pressure on cervical vertebra are added into the flat pad and cushion having a convex portion to be inserted into a cover, and further comprising that the flat pad, the cushion having a convex portion, the pad for adjusting a height and the pad for adjusting pressure on cervical vertebra are pre-prepared. In addition a bottom of the cushion having a convex portion is flat and an upper surface of the cushion having a convex portion is curved for fitting a shape of a portion of a user's anatomy to conform to a pillow user's head and cervical vertebra.

Therefore, a plurality of prepared members such as a flat pad, a cushion having a convex portion, a pad for adjusting a height and a pad for adjusting pressure on cervical vertebra are prepared, combined and inserted into a cover so that the most favorite height, shape, hardness, etc. relating to the pillow user can be delicately adjusted. The most comfortable pillow to a pillow user can be affirmatively set, and the pillow user can experience peaceful sleep with a relaxed posture and without preventing him from turning in bed, without causing headaches and feelings of nausea which would be otherwise caused by receiving pressure on his neck. Moreover, when an insertion member of the pillow is torn or worn out, the pillow for an individual can be easily repaired to be used again by replacing only the insertion member having a torn or worn out portion. When the height and shape of the pillow no longer fit the pillow user's figure, the comfortable pillow can be reset by simply adjusting the numbers of pads for adjusting a height and pads for adjusting pressure on the user's cervical vertebra.

By using a cushion having a convex portion whose bottom is flat and upper surface is a convex portion is curved for fitting a shape of a portion of a user's anatomy to conform to a pillow user's head to neck, the inventive pillow for an individual can support the cervical vertebra of the pillow user when he sleeps and have an effect to enable blood of nervous system and sinews which are close to the cervical vertebra circulate smoothly.

The present invention relating to the claims also relates to a pillow for an individual as set forth above and wherein at least charcoal is used as a stuffing material of the flat pad. With this material, the pillow can keep the most pleasant temperature and humidity for sleep and has a clean air effect so that a pillow user can have a comfortable sleep.

The present invention relating to the claims also relates to the method for producing a pillow for an individual comprising a set of steps such that where the pillow user tends to sleep facing upward, the pillow user's most favorite height of the pillow is pre-selected as a value between a value of the double thick of the pillow user's palm and an average value after measuring a thickness of a pillow user's palm, a distance from ear to armpit of the pillow user, and an average value between a value of the thickness of the pillow user's palm and a distance from the ear to armpit of the pillow user. In case that a pillow user tends to lie on his side, the pillow user's most favorite height of the pillow is pre-selected as a value between the distance from his ear to armpit and the average value (average value between a value of the thickness of the pillow user's palm and a distance from the ear to armpit of the pillow user). Then, using the above quantities, a method of setting a temporary pillow by inserting combination of flat pads, a cushion having a convex portion, necessary numbers of pads for adjusting height and pads for adjusting pressure on cervical vertebra based on the heights and the measured values above, into a cover and initially use such temporary pillow by a pillow user. The pillow user then defines the pillow user's favorite height and shape from the starting point of the temporary pillow by being adjusted, by employing said pads for adjusting a height and pads for adjusting pressure on cervical vertebra. Therefore, the most comfortable height and shape of a pillow which may differ between individuals based upon their personal body figure and sleeping posture can be delicately adjusted, to result in the most favorite pillow of that individual then being set.

DETAILED DESCRIPTION OF THE PREFERRED EMBODIMENT

Figure 1:
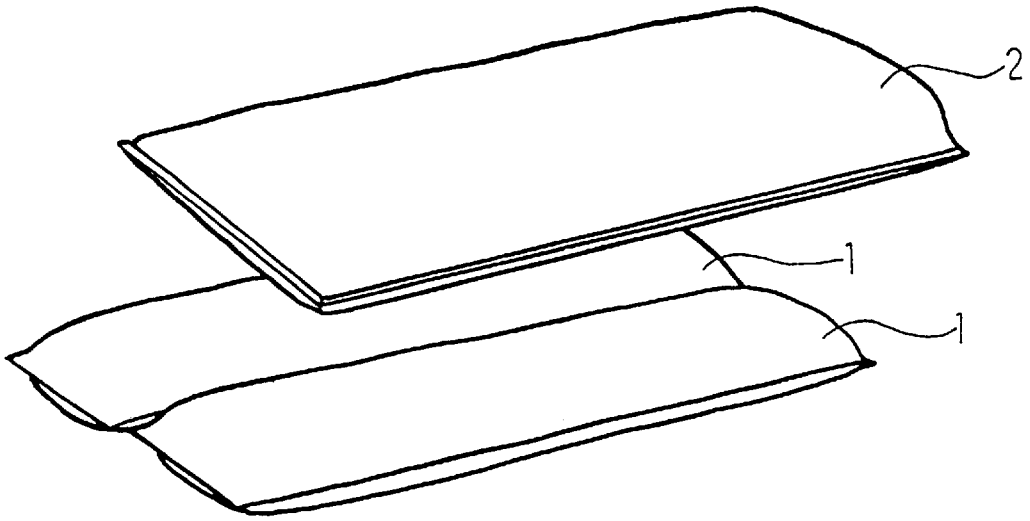
FIG. 1 is a perspective view showing flat pads and a cushion having a convex portion which are a basic components of a temporary pillow.

Embodiments of a pillow for an individual relating to the present invention will be described in detail hereinafter.

A pillow for an individual relating to the present invention has the pillow user's most comfortable height and shape. The most comfortable height and shape of a pillow are differ in accord with personal body figure and sleeping posture of a pillow user, and therefore after measuring a personal figure and identifying a sleeping position, the most comfortable height and shape is determined, and then a pillow for an individual can be produced.

With regard to a pillow for an individual relating to the present invention, the most important point is a height of the pillow, and as earlier mentioned, the most comfortable height of a pillow is determined by a personal figure and a sleeping posture for each pillow user. The comfortable height and shape of a pillow will differ in the case that a pillow user tends to sleep on their back facing upward or in the case that a pillow user tends to lie on his side, in addition to the personal body figure of the pillow user.

For example, in case that a pillow user tends to sleep facing upward, the most comfortable height is double the thickness of the pillow user's palm. In case that a pillow user tends to lie on his side, the most comfortable height is a distance from ear to armpit of the pillow user. However, as people can turn in bed during sleep and since it is expected that they sleep facing up ward and lie on their side, the most comfortable height must be determined by considering these points.

In case that a pillow user tends to sleep facing upward, measuring the thickness of a palm and the distance from ear to armpit of the pillow user, an average value of the thickness of the user's palm and the distance from the user's ear to armpit is calculated. Then, the most comfortable height is a value between this average value and the value of double the thickness of the pillow user's palm.

In case that a pillow user tends to lie on his side, a measurement of a thickness of the user's palm and a distance from the ear to the armpit of the user are measured, and an average value of the thickness of the pillow user's palm and the distance from the user's ear to his armpit is calculated. Then, the most comfortable height is a value between such average and the magnitude of the distance from the ear to armpit of the pillow user.

Based on the most comfortable height and values which are measured and calculated in these methods, initially, a temporary pillow is set. Flat pads and a cushion having a convex portion are basic components of the temporary pillow. If necessary, additional numbers of pads for adjusting a height and additional numbers of a pad for adjusting pressure on cervical vertebra are added. Then, a pillow user actually uses the temporary pillow. Subsequently, a pillow which has his favorite height is formed by adjusting numbers and positions of both the pads for adjusting a height and the pads for adjusting pressure on cervical vertebra are set within a covering.

Figure 2:
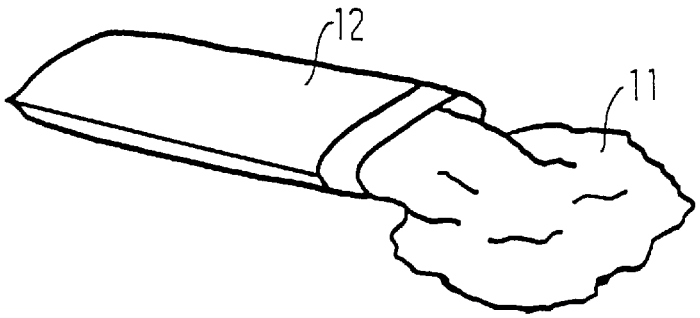
FIG. 2 is a perspective view showing that a flat pad comprises a bag filled with a stuffing material.

The method for producing a pillow for an individual relating to the present invention will be described hereinafter referring to drawings. In the steps of producing a pillow for an individual relating to the present invention, at the outset, a temporary pillow is initially set up based on the most comfortable height and values which are calculated and measured by the above described. A flat pad 1 and a cushion having a convex portion 2 are basic components of the temporary pillow shown in FIG. 1. As FIG. 2 shows, a flat pad 1 of FIG. 1 is formed by filling a stuffing material 11 into a bag for stuffing materials 12. As a stuffing material 11, everything which is commonly used as a stuffing material of a pillow such as chaff, buckwheat chaff, cotton, feathers, foaming synthetic material resin pieces and the like is favorably used. In addition, a material which fits hardness, fragrance and so on of a pillow user's taste may also be used.

In the present invention, charcoal is especially favorably utilizable as a stuffing material 11. Since charcoal has a characteristic of absorbing poisonous material, moisture and so on in air and has a superior ventilation and moisture vaporization characteristic, charcoal is preferably used. Therefore, if charcoal is used as a stuffing material 11, a pillow is given characteristics such as superior ventilation, absorption of humidity and moisture vaporization and produces a clean air effect. In addition, with this material, the most comfortable temperature and humidity for sleep can be maintained. The effects of the use of charcoal are semipermanent and if the cleaning effects of the charcoal become weak, the effects can be reinstituted by exposing the flat pad 1 to sun light so that the effects from using charcoal are again maintained. If charcoal is used as a stuffing material 11, a the preferred type of charcoal used for the pillow is not particularly restricted. However, either "Shirotan" or "Hakutan" (White charcoal) made by a way which material wood is burnt with temperature between 400 and 750 and 1,000° C. and carbonized at a temperature between 350 and 520° C., or a black coal made in a way which wood material is burnt at temperature between 400 and 750° C. and carbonized with temperature between 250 and 450° C. may preferably also be used. As a "Shirotan" or "Hakutan", "Binchotan" is made by a process in which Ubamegashi, a kind of oak (*Quercus phillyraeoides*), is burned as a wood material with a temperature around 1000° C., a charcoal whose wood material is selected from a group consisting of oak or a group of Japanese oak belonging to the beech family (Fagaceae), Japanese oak genus (Quercus), a charcoal whose wood material is a bamboo belonging to rice family (Gramineae), a charcoal whose wood material is a needle leaf tree such as Japanese cedar (*Cryptomeria japonica*), Japanese cypress (*Chamaecyparis obtusa*), Japanese red pine (*Pinus densiflora*), Japanese black pine (*Pinus thunbergii*), and so on are given as an examples of preferably acceptable charcoals.

As a black coal, charcoal whose wood material is a kind of oak (*Quercus acutissima* or *Quercus serrta Thunb*) is given as an example of a black coal. Particularly, since the diameter of the inside tube of charcoal made from bamboo is larger than ones of other kinds of charcoal, the charcoal made from bamboo has a strong absorption against a poisonous material and moisture in air. Moreover, as it has the most comfortable hardness as a stuffing material 11 of a pillow, and it may be preferably used in the invention. A shape charcoal particles used for the pillow is not especially restricted, but a shape which is proper as a stuffing material for a pillow is typically granular, powdery and the like.

In case that charcoal is used, it is possible either to use either charcoal alone as a stuffing material 11, or to add buckwheat and tubular synthetic resin materials into charcoal so that the flat pad 1 can have a proper elasticity. Due to the addition of these materials, the flat pad (1) can keep a proper height.

By using Japanese cypress (*Chamaecyparis obtusa*) or a cedar belonging to cedar family (Taxodiaceae), the flat pad 1 can have an antibacterial effect and an insect repellent effect. Therefore, if stuffing materials 11 comprising charcoal and Japanese cypress (*Chamaecyparis obtusa*) or a cedar is used, a development of harmful elements including insects, tics and a mold can be prevented and avoided. If Japanese cypress (*Chamaecyparis obtusa*) or a cedar is used, it is desirable that they have a proper shape such as granular, powdery, chips-shaped and with at least one sliced or ground as a stuffing material.

As other stuffing materials include fragrant woods such as camphor tree (*Cinnamom urn camphora Sieb*), crawb (*Eugenia caryop hyllata*), eucalyptus (*Eucalyptus globulus*), Japanese red pine (*Pinus densiflora*), kinds of white fir (*Abies sachalinensis and Abies mayriana*), spruce (*Picea jezoensis*), hibaarborvitae (*Thujopsis dolabrata*) and fir (*Abies firma*), herbs such as dokudami (*Houttuynia cordata*), tea leaves (*Thea sinensis*), sage (*Salvia officinalis*) and rosemary (*Rosemarinus officinalis L.*) and potpourri made from such ascamomile (*Matricaria Chamomilla*), sandalwood (*Santalum album L.*), rosewood (*Aniba rosaeo dora*), geranium (*Pelargonium inquinans*), lavender (*Lavandula officinalis*), bitter orange (*Citrus aurantium bergamia*), jasmine (*Jasminum officinale*), comfrey (*Symphytum officinale L.*), navel orange (*Citrus sinensis*), cotton, wool, feather, down, buckwheat chaff and ester cotton may also preferably be used.

A material of the bag for stuffing materials 12 used for a flat pad 1 is not especially restricted, but if charcoal is used as a stuffing material, non-woven fabric, especially one having a high density, is preferably used since fine powder of charcoal easily corns out from a bag for stuffing materials 12. As non-woven fabric has a superior ventilation and moisture vaporization, it is preferably used.

A shape of flat pad 1 seen from above is not especially restricted. In either case the shape is almost same as the shape of a pillow seen from above or that it is almost same as a half shape of a pillow as is shown FIG. 1. The number of flat pads 1 is also not especially restricted, but if a flat pad 1 which is half as large as the pillow shown in Figure is used, two pieces of the flat pad 1 may be used.

Figure 3:
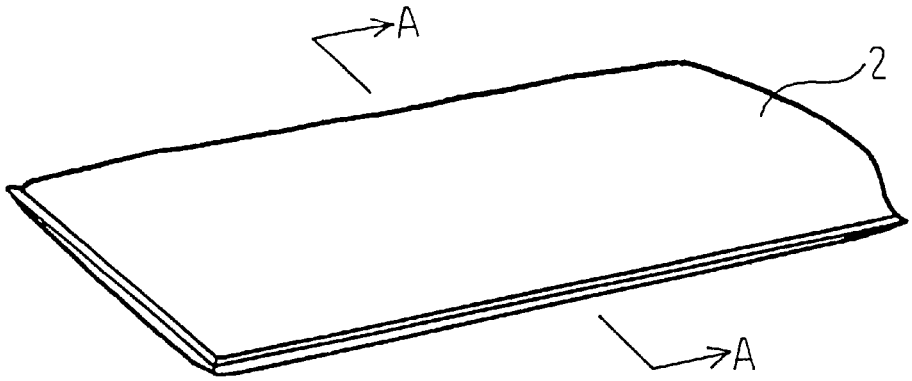
FIG. 3 is a perspective view of a cushion having a convex portion.
Figure 4:
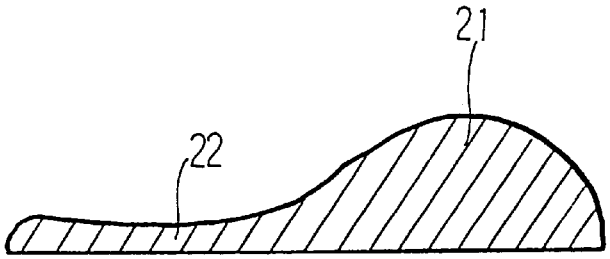
FIG. 4 is a view taken along the line A—A of FIG. 3.

A cushion having a convex portion 2 may have a rectangular shape as is seen in FIG. 3. As FIG. 4 shows, a bottom of the cushion of FIG. 3 may be flat and an upper surface of the cushions is curved for fitting a shape of a user's body portion between head and neck of a pillow user. This shape comprises a neck supporting portion 21 and a head supporting portion 22.

Owing to the aforementioned structure, a pillow can properly support all portions of the user such as nerves, blood vessels, skin and muscles at the neck when sleeping, and blood can smoothly flow into nervous systems and sinews which are close to the cervical vertebra.

Figure 5:
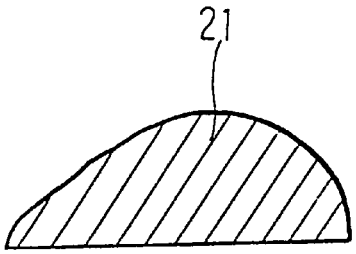
FIG. 5 is a cross-sectional view of a cushion having a convex portion.

A cushion 2 having a convex portion can have a shape which is not restricted only to the shapes shown in FIGS. 3 and 4 , and may be made into a shape having only a portion 21 of which is for supporting the neck which is almost half as large as a pillow seen from above. Refer to FIG. 5.

As a material of a cushion having a convex portion 2 which will be a cushion of a pillow for an individual relating to the present invention, cotton and the like which has a soft elasticity like a cushion is preferably used. Polyester cotton may especially be used as it has a superior moisture vaporization.

Figure 6:
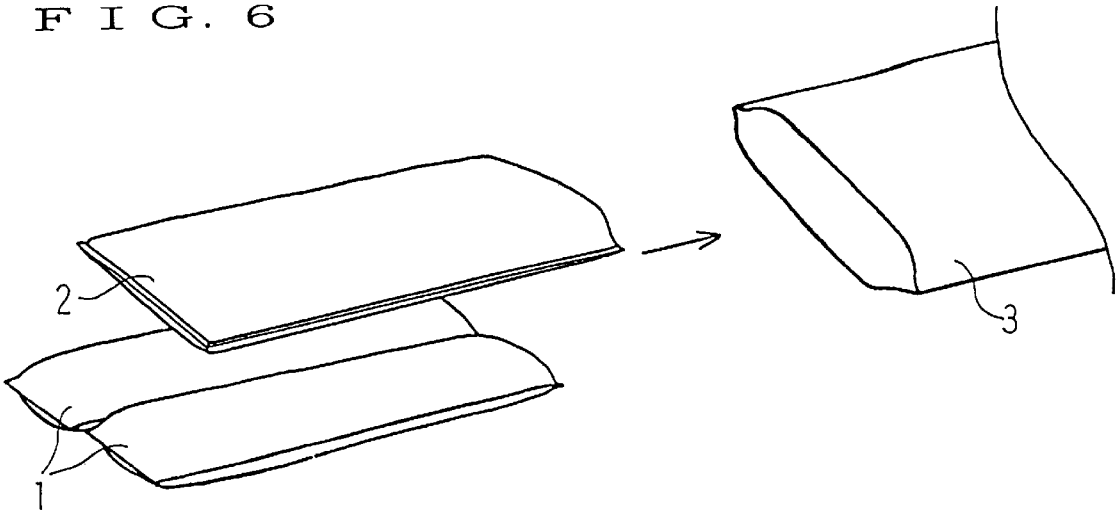
FIG. 6 is a view showing a temporary pillow being set up by inserting flat pads and a cushion having a convex portion in a cover.
Figure 7:
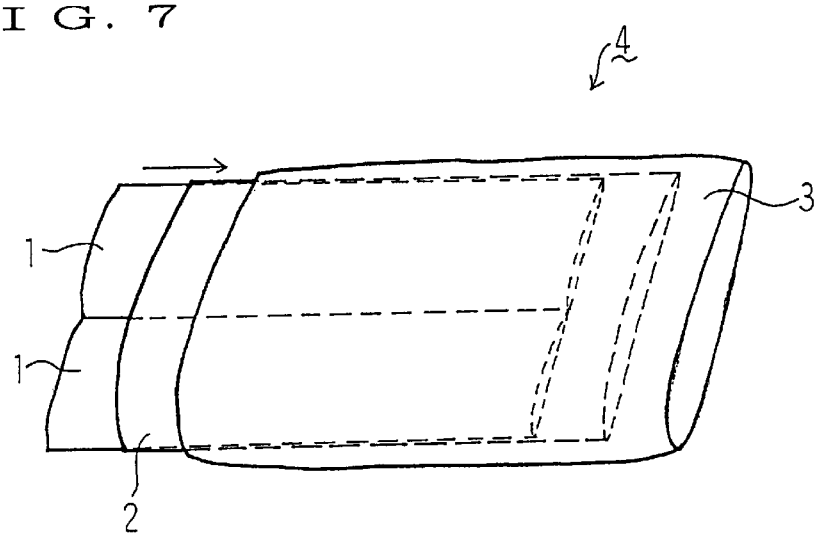
FIG. 7 is a view showing a temporary pillow being set up by inserting flat pads and a cushion having a convex portion in a cover.

An object which has a shape shown in FIGS. 3, 4 and 5 or a bag filled with polyester cotton and the like can be used as a cushion having a convex portion 2. Polyester cotton formed into a shape shown in FIGS. 3, 4 and 5 or such polyester cotton stuffed in a bag may be used as a cushion having a convex portion 2. However, for keeping a shape of a cushion having a convex portion 2, cotton with a compression treatment and formed into a shape shown in FIGS. 3, 4 and 5 is preferably used. Such flat pad 1 and a cushion 2 having a convex portion are a basic component of a temporary pillow, and in the case that a pillow having a height and a shape based on a calculated height and measured value are formed by only the flat pad 1 and the cushion having a convex portion 2, as in FIGS. 6 and 7 show, the flat pad 1 and the cushion having a convex portion 2 are stored in a cover 3 to form the temporary pillow.

In case that a height is very low because of using only the flat pad 1 and a cushion having a convex portion 2 or because a height of a portion supporting a neck of the cushion having a convex portion 2 does not fit a pillow user's figure, necessary numbers of a pad for adjusting a height 5 and a pad for adjusting pressure on cervical vertebra 6 are added.

Figure 8:
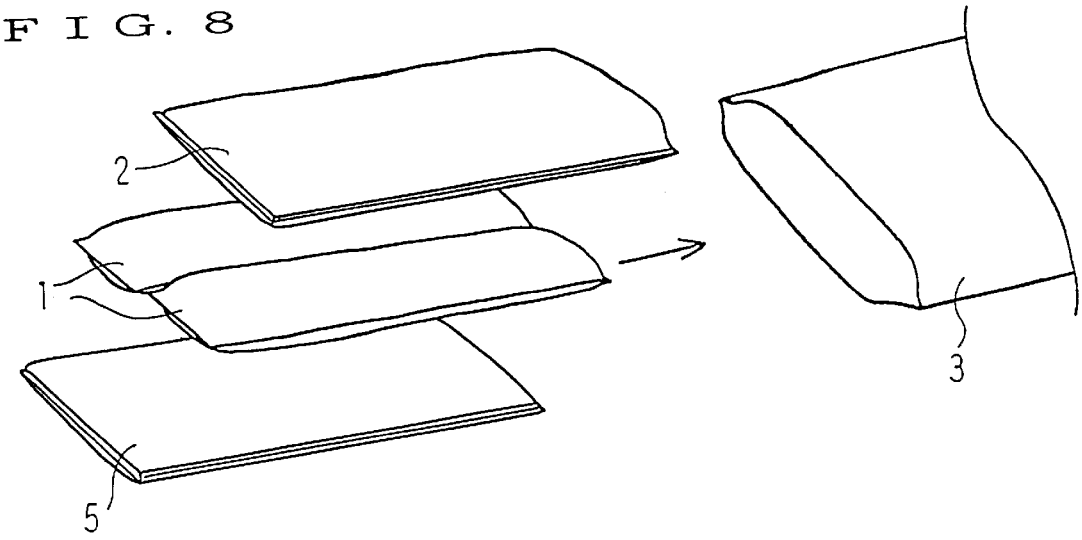
FIG. 8 is a view showing the addition of a pad for adjusting height and insertion into a cover.

If a height of the pillow is low, as FIG. 8 shows, a pad for adjusting a height 5 can be added. In the example shown in FIG. 8, one piece of a pad for adjusting height 5 is added, but it is possible to add a plurality of pads for adjusting a height 5 for setting the most comfortable height. In the example shown in FIG. 8, the pad for adjusting height 5 is stored lying under the flat pad 1, but it may be possible to insert the pad for adjusting a height 5 between a cushion having a convex portion 2 and the flat pads 1.

Figure 9:
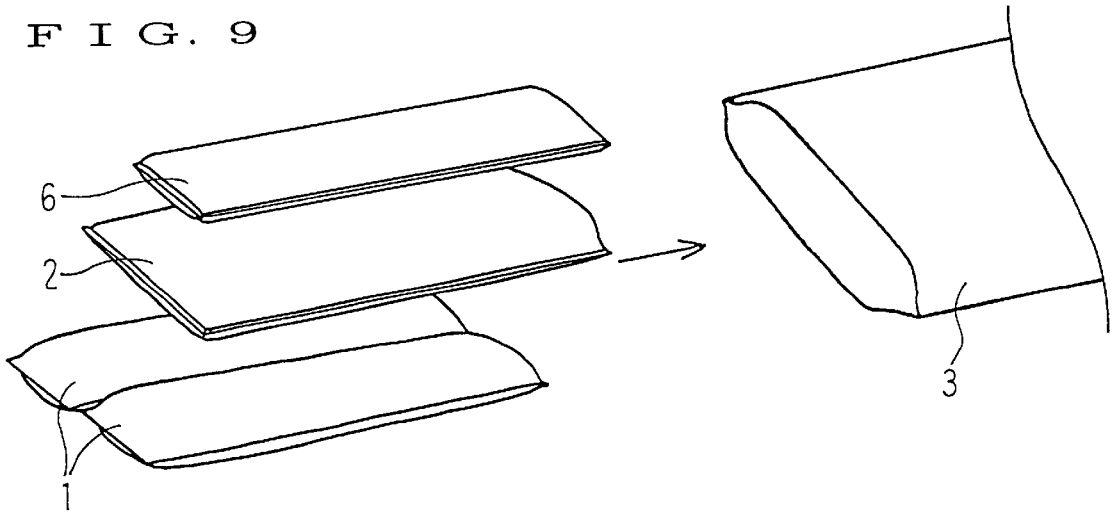
FIG. 9 is a view showing that a pad for adjusting pressure on cervical vertebra being stored on the back portion of the upper surface of a cushion having a convex portion.
Figure 10:
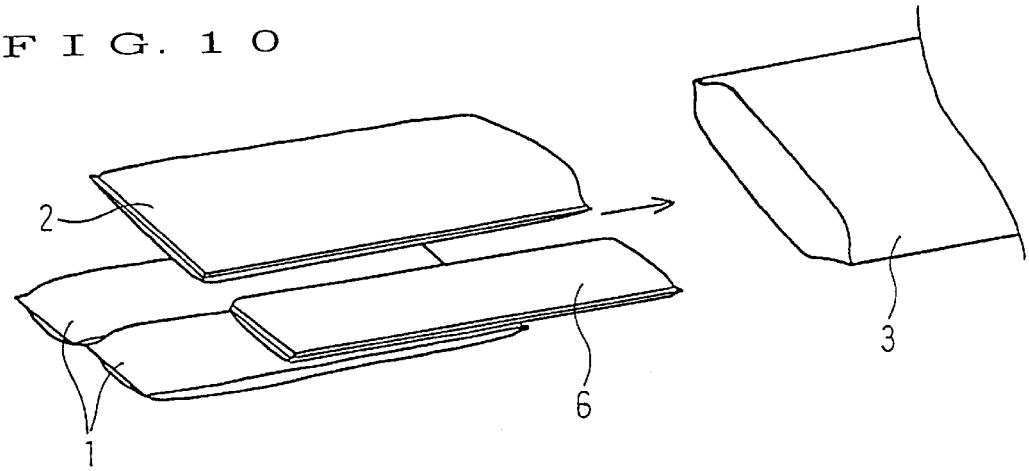
FIG. 10 is a view showing a pad for adjusting pressure on cervical vertebra being stored at the front portion of the under side of a cushion having a convex portion.

As FIGS. 9 and 10 show, by putting the pad for adjusting pressure on cervical vertebra 6 on the back or the front of the upper surface of the cushion having a convex portion 2, a height of a portion supporting a neck can be adjusted to the pillow user's most comfortable height. The number of the pads for adjusting pressure on cervical vertebra 6 which are employed is not restricted, and it is not necessary to use only one piece of a pad for adjusting pressure on cervical vertebra 6 which is illustrated in FIGS. 9 and 10. Therefore, it is possible to use more than two pieces of the pad for adjusting pressure on cervical vertebra 6 in the invention. In setting up a temporary pillow 4, a necessary number of the pads for adjusting pressure on cervical vertebra 6 is initially determined based on the measured values set forth above. A calculated height, and the accurate adjustment of the pressure for a cervical vertebra is subsequently set based on a pillow user's touch and experience which he actually feels on the temporary pillow 4 by actually using it over some time. The method of the adjustment will be described hereinafter.

Since the pad for adjusting pressure on cervical vertebra 6 is stored at the front or the back portion of a pillow in order to adjust a height and a shape of the portion which supports the neck, the shape of it seen from above is almost rectangular, and the longest line of it is almost as long as the longest line of a pillow which has a rectangular shape as normally seen from above, and the shortest line of it is almost half as long as the shortest line of a pillow.

As for a stuffing material to be used for the pad for adjusting a height 5 and the pad for adjusting pressure on cervical vertebra 6, a material such as polyester cotton having a cushion elasticity as well as the same as is used for a cushion having a convex portion 2 may be used. It is possible that an expanse of rectangular polyester cotton could be used as the pad for adjusting a height 5 or for the pad for adjusting pressure on cervical vertebra 6, or that rectangular polyester cotton which is stuffed in a bag can be used as a pad for adjusting a height 5 or for a pad for adjusting pressure on cervical vertebra 6.

As aforementioned, a temporary pillow 4 has a flat pad 1 and a cushion having a convex portion 2 as its basic components. If necessary, a pad for adjusting a height 5 and a pad for adjusting pressure on cervical vertebra 6 can be added, and inserted into the cover 3. Refer to FIGS. 6, 7, 8, 9 and 10.)

Figure 11:
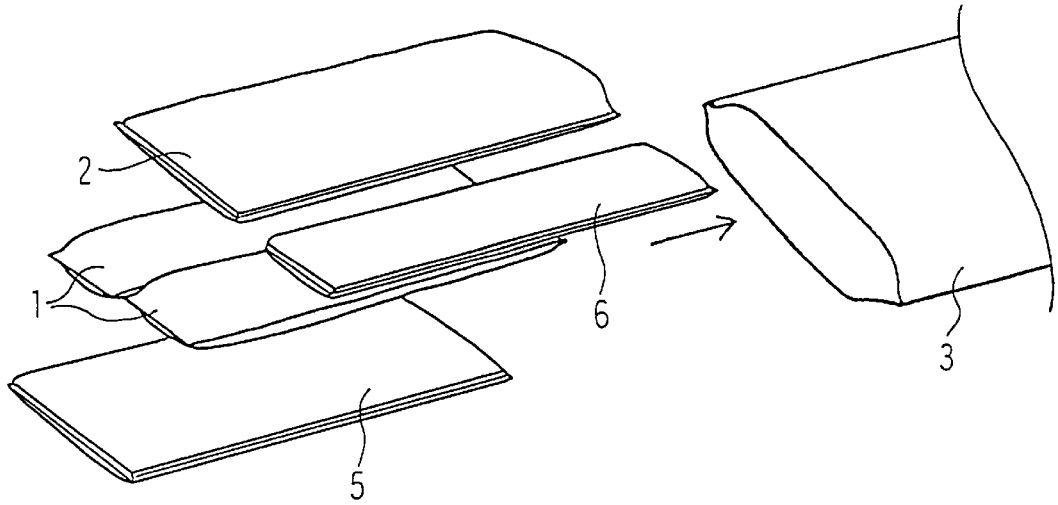
FIG. 11 is a view showing that each of a pad for adjusting a height and a pad for adjusting pressure on cervical vertebra are being added and placed within a cover.

The numbers and the positions of the pad for adjusting height 5 and the pad for adjusting pressure on cervical vertebra 6 used for a pillow will be different for each a pillow user. For example, if each of the pads for adjusting height 5 and each of the pads for adjusting pressure on cervical vertebra 6 are used, then the members such as flat pads 1, a cushion having a convex portion 2, the pad for adjusting height 5 and the pad for adjusting pressure on cervical vertebra 6 may be combined as shown in FIG. 11 and then inserted into the cover 3.

All types of covers which have a size which can store all of the flat pads 1, cushions having a convex portion 2, pads for adjusting height 5 and pads for adjusting pressure on cervical vertebra 6 in the temporary pillow 4 are preferably utilizable. In the present invention, as seen in FIG. 12, shows a cover 3 provided with a bag or cushion 31 for storing members 32 in its inside space and this combination may be preferably used.

Figure 12:
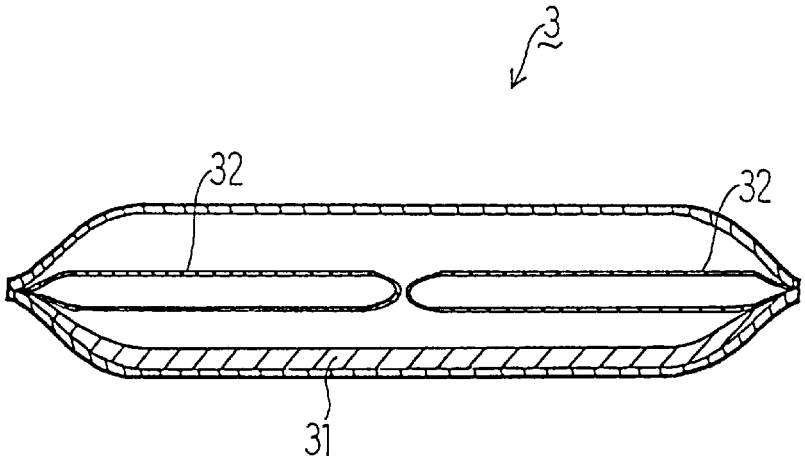
FIG. 12 is a cross-sectional view of a cover provided cushion materials and a bag for storing members.

It is desirable that cushion 31 is placed at a bottom of the cover 3 as is shown in FIG. 12. In this position, the bottom of the pillow is stable and is given a soft cushion elasticity. In the event that a pillow using the cover 3 is configured using the cushion 31, it is natural that the height of the pillow is completed in consideration of the thickness of the cushion 31.

A bag for storing members 32 may be provided for keeping the positions of both the pads for adjusting pressure on cervical vertebra 6 and the flat pads 1 in place. As FIG. 12 shows, by affixing one end of the bag for storing members 32 to one end of a cover 3, the bag for storing members 32 is provided in the cover 3. The pad for adjusting pressure on cervical vertebra 6 may be stored at the front or the back portion of a pillow as aforementioned. The resulting shape as seen from above is rectangular and is half as large as a pillow as seen in FIGS. 9, 10 and 11. As FIGS. 9, 10 and 11 show, if the pad for adjusting pressure on cervical vertebra 6 is stored at either the front portion of the under side or at the back portion of the upper surface of a cushion having a convex portion 2, it might move in the front and the back. Therefore, when the pad for adjusting pressure on cervical vertebra 6 is used, it is stored in a bag for storing members 32 provided within a cover 3 so that the pad for adjusting pressure on cervical vertebra 6 should not move significantly.

The flat pad 1 can be stored in the bag for storing members 32, also. If the flat pad 1 having a shape to be almost half size of a pillow as shown in FIG. 1 is used, then storing the flat pad 1 in the bag for storing members 32 will prevent the flat pad 1 from moving. Moreover, a user may choose to either put the flat pad 1 on the cushion having a convex portion 2 or to put the cushion having a convex portion 2 on the flat pad 1.

Figure 13:
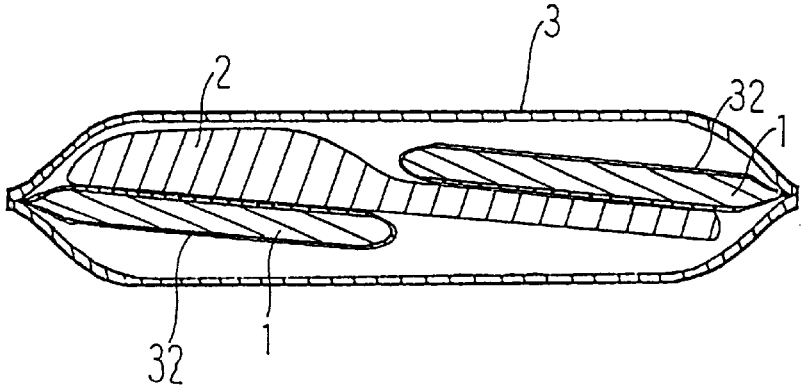
FIG. 13 is a cross-sectional view of a cover into which is provided a bag for storing members and in which flat pads and a cushion having a convex portion are stored.

For example, if a pillow is constructed which will have a fragrance or some other environmental effect based upon the stuffing material utilized in the flat pad 1, such as charcoal as seen in FIG. 13, only the flat pad 1 which is stored in a portion where a head is placed (the back portion of the pillow) is put on the cushion having a convex portion 2.

Materials for the cover 3 and a bag for storing members 32 are also not restricted, and both cloth and mesh material may be used. In particular consideration of the texture which a pillow user feels when using the pillow, a soft material such as cotton cloth is preferably utilizable for the cover 3.

For determining a final height and shape of a pillow for an individual relating to the present invention, a temporary pillow 4 must be actually used by a pillow user because it cannot be determined for certain that the height and the shape of the configuration set based on the calculated height and measured value can best fit the pillow user's body Figure. The texture which the pillow user feels in using the pillow is very important to determine a final height and shape of the pillow.

After the pillow user has used the temporary pillow 4 and after the height and shape which the pillow user feels the most comfortable with are determined, a pillow for an individual can be configured and set. This final adjustment is preferably formed using a pad for adjusting a height 5 and a pad for adjusting pressure on cervical vertebra 6.

However, the final adjustment of the height is set within the rage of the calculated and most comfortable height. In other words, if a pillow user tends to sleep on their back facing upward, the adjustment is set between a value of the double thick of the pillow user's palm and an average value (an average value between the double thickness of the pillow user's palm and a distance from ear to armpit of the pillow user). If a pillow user tends to lie on his side, the height is adjusted between the distance from ear to armpit of the pillow user and the aforementioned average value.

Figure 14:
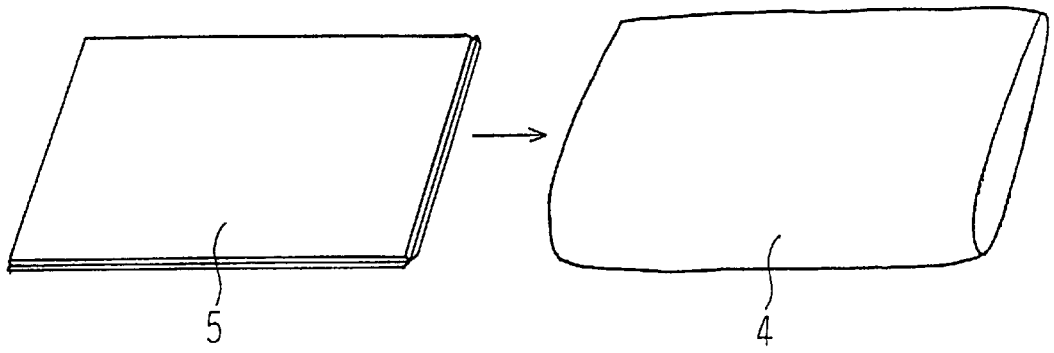
FIG. 14 is a view showing a pad for adjusting height is added and stored in a temporary pillow.

The adjustment of the height is set by increasing or decreasing a number of the pads for adjusting height 5. If a pillow user feels the height of the temporary pillow 4 is low by having used it, as is shown in FIG. 14, pads for adjusting height 5 are added one by one so that the most comfortable height of the pillow user is set. Using a temporary pillow 4, if the pillow user feels the height of the pillow is too high, the pads for adjusting height 5 which are stored within the temporary pillow 4 are taken out sequentially to configure the most comfortable height.

The pad for adjusting a height 5 can be preferably stored under the flat pad 1 or between the flat pad 1 and the cushion having a convex portion 2 in the final pillow form as well as the case of producing the temporary pillow 4.

Figure 15:
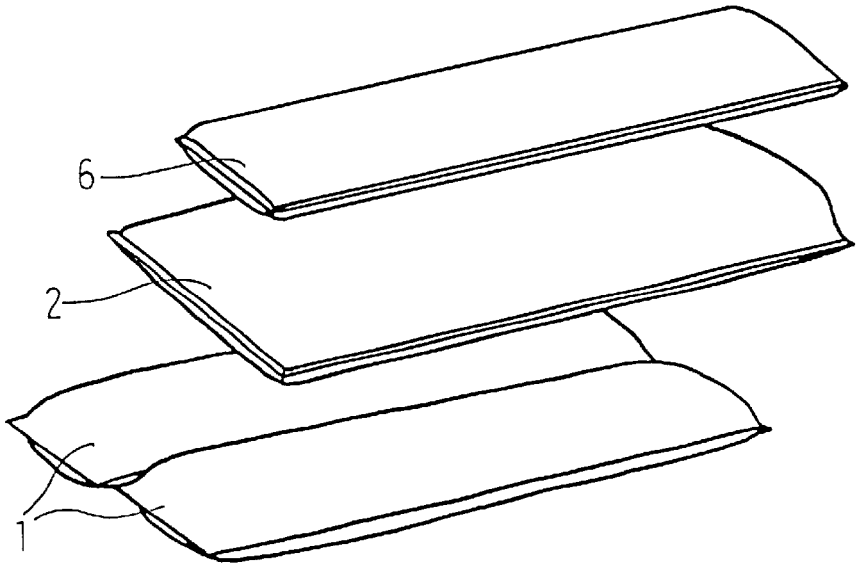
FIG. 15 is a view showing a pad for adjusting pressure on cervical vertebra is placed lying on the back portion of the upper surface of a cushion having a convex portion.

An adjustment of a height and a shape of a portion supporting the human neck is set by increasing or decreasing a number of the pads for adjusting pressure on cervical vertebra 6 and with respect to the position in which they are stored. The adjustment of the pad for adjusting pressure on cervical vertebra 6 is an adjustment for a pressure on the cervical vertebra. If the pillow user feels pressure on the cervical vertebra when he uses the temporary pillow 4, then as seen in FIG. 15, the pad for adjusting pressure on cervical vertebra 6 is placed in a position lying on the back portion of the upper surface of the cushion having a convex portion 2. In other words the portion of the assembly supporting the head, is stored in a cover 3 so that pressure on the cervical vertebra is reduced. If the pad for adjusting pressure on cervical vertebra 6 is stored lying on the front portion of the under side of the cushion having a convex portion 2, that is the portion supporting the neck, when the temporary pillow 4 is produced, the pad for adjusting pressure on cervical vertebra 6 is then preferably taken out so that pressure on neck is reduced.

Figure 16:
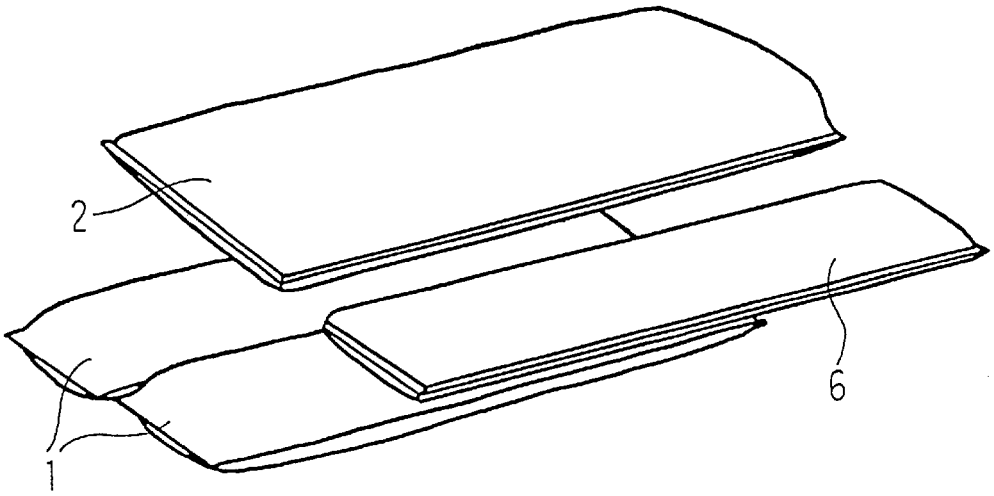
FIG. 16 is a view showing a pad for adjusting pressure on cervical vertebra is being placed lying on the front portion of the under side of a cushion having a convex portion.

Vice versa, if the height of the portion supporting neck of the cushion having a convex portion 2 is not high enough, as FIG. 16 shows, the pad for adjusting pressure on cervical vertebra 6 is placed in a position lying on the front portion of the under side of the cushion having a convex portion 2. In other words, the portion supporting neck, and stored in a cover 3 so that the height of the portion supporting neck becomes higher. If the pad for adjusting pressure on cervical vertebra 6 is stored at the back portion of the upper side of the cushion having a convex portion 2, that is, such that the portion supporting head when the temporary pillow 4 is configured and set, the pad for adjusting pressure on cervical vertebra 6 is taken out so that pressure on neck is increased.

By the method aforementioned, the height and the shape of the potion supporting neck is finally determined by adjusting the number and the storing position of the pad for adjusting pressure on cervical vertebra 6.

FIGS. 15 and 16 show that the pad for adjusting pressure on cervical vertebra 6 is added in case that the temporary pillow 4 comprises only the flat pad 1 and the cushion having a convex portion 2. In the FIGS. 15 and 16, the pad for adjusting pressure on cervical vertebra 6 is stored lying on or under the cushion having a convex portion 2, but the storing position is not restricted, and it may be stored at the position which keeps the curved-shape of the cushion having a convex portion 2.

As aforementioned, by initially using the temporary pillow 4 by a pillow user, the final height and shape are determined, and then, a pillow for an individual is configurably set by combining necessary members.

As the numbers and the storing positions of the pad for adjusting a height 5 and the pad for adjusting pressure on cervical vertebra 6 of each pillow are different, the pillow user's most comfortable height and shape can be set. Therefore, the height and the shape of the pillow which fit the pillow user's body Figure do not prevent the pillow user from turning in bed, and the pillow user can sleep without headache and does not feel nausea by receiving pressure on his neck.

As aforementioned, a pillow for an individual relating to the present invention is set by combining a prepared flat pad, a prepared cushion having a convex portion, a prepared pad for adjusting a height and a prepared pad for adjusting pressure on cervical vertebra. And then, a completed pillow for an individual is produced by combining necessary members through the steps of examining the sleeping posture of the pillow user, measuring the personal figure of the pillow user, setting a temporary pillow, and then later adjusting the height and the shape of the pillow by testing of the temporary pillow initially set.

For example, a prepared flat pad, a prepared cushion having a convex portion, a prepared pad for adjusting height and a prepared pad for adjusting pressure on cervical vertebra are displayed at a store. After a sleeping posture of a pillow user is examined and his personal figure is measured, a temporary pillow is configurably set by combining the flat pad, the cushion having a convex portion, the pad for adjusting a height, and the pad for adjusting pressure on cervical vertebra then and there.

Then, the height and the shape of the temporary pillow is adjusted by testing the temporary pillow by having the user utilize the pillow. Then a pillow for an individual is produced by combining all necessary members mentioned above. After the sleeping posture of the pillow user is examined and his personal figure is measured, the temporary pillow can be set at a factory, and a pillow for an individual may be further adjusted and set at a store by adjusting the height and the shape.

A pillow for an individual relating to the present invention comprises a plurality of a flat pads, a cushion having a convex portion, pads for adjusting height and a pads for adjusting pressure on cervical vertebra, and which are stored in a cover. Thereafter, if any of these member is torn or worn out, it is possible to repair the pillow for an individual, by replacing the worn out members. If the height and the shape do not fit the pillow user's body figure, it is easy to configure the most comfortable pillow again by adjusting numbers of the pads for adjusting height and the pad for adjusting pressure on cervical vertebra.

What is claimed is:

1. A pillow for an individual having a flat pad, a cushion having a convex portion, and a pad for adjusting pressure on cervical vertebra as basic components which are prepared in advance, wherein:

at least one flat pad is inserted into a cover and placed at the bottom surface side of said convex portion and a second flat pad placed on the top surface of the cushion adjacent said convex portion;

said flat pad, said cushion having a convex portion, and said pad for adjusting pressure on cervical vertebra each having a substantially rectangular shape in a plan view:

a length of a long side of each said rectangular shape is substantially equal to a length of a long side of said pillow for an individual in a plan view;

a length of a short side of said pad for adjusting pressure on cervical vertebra in a plan view is substantially half of a length of a short side of said pillow for an individual in a plan view;

a bottom surface of said cushion having a convex portion is flat; and a top surface of said cushion having a convex portion is shaped to fit with a curved surface from a person's head to the neck in a short side direction.

2. A pillow for an individual as set forth in claim 1, wherein more than one pad for adjusting a height which plan view is almost equal to that of said pillow for individual is added to the bottom surface side of said convex portion.

3. A pillow for an individual as set forth in claim 1, wherein charcoal is used as a stuffing material of said flat pad.

* * * * *